US007159285B2

(12) United States Patent
Karlsson

(10) Patent No.: US 7,159,285 B2
(45) Date of Patent: Jan. 9, 2007

(54) SEAT BELT ARRANGEMENTS FOR CHILD SAFETY SEATS

(75) Inventor: Rojel Karlsson, Hestra (SE)

(73) Assignee: Kendrion Holmbergs, Anderstorp (SE)

( * ) Notice: Subject to any disclaimer, the term of this patent is extended or adjusted under 35 U.S.C. 154(b) by 0 days.

(21) Appl. No.: 10/969,871

(22) Filed: Oct. 22, 2004

(65) Prior Publication Data

US 2005/0115035 A1 Jun. 2, 2005

(30) Foreign Application Priority Data

Oct. 24, 2003 (SE) ..... 0302823

(51) Int. Cl.
*A44B 11/26* (2006.01)

(52) U.S. Cl. ..... 24/650; 24/579.11; 24/DIG. 35

(58) Field of Classification Search ..... 24/DIG. 31, 24/DIG. 32, DIG. 35–DIG. 37, DIG. 43–DIG. 48, 24/DIG. 51, DIG. 52, 573.09, 573.11, 579.11, 24/593.1, 628, 684, 630–632, 650, 647, 643, 24/664; 297/468; 280/801.1
See application file for complete search history.

(56) References Cited

U.S. PATENT DOCUMENTS

| | | | |
|---|---|---|---|
| 3,686,720 | A | 8/1972 | Wehner |
| 4,228,567 | A | 10/1980 | Ikesue |
| 4,617,705 | A | 10/1986 | Anthony |
| 4,677,715 | A | 7/1987 | Escaravage |
| 4,692,970 | A | 9/1987 | Anthony |
| 5,267,377 | A | 12/1993 | Gillis |
| 5,406,681 | A | 4/1995 | Olson |
| 5,813,097 | A | 9/1998 | Woellert |

FOREIGN PATENT DOCUMENTS

| | | |
|---|---|---|
| DE | 4344023 | 6/1995 |
| EP | 0574476 | 9/1992 |
| EP | 0696890 | 10/1994 |

*Primary Examiner*—Jack W. Lavinder

(57) ABSTRACT

A buckle mechanism for a seat belt arrangement of a child safety seat comprises a guiding member forming at least one internal cavity for guiding and receiving at least one tongue of a tongue member, at least one latch for engaging with and locking the at least one tongue and disengaging means for disengaging the at least one latch from the at least one tongue. The buckle mechanism further has the at least one latch pivotably secured and connected with an anchor pin, to which webbing of a seat belt is attached, the other webbing being attached in a way known per se to the at least one tongue member. The at least one latch engages with the at least one tongue and the force transmission from the webbings through the mechanism only consists of the at least one tongue, the at least one latch and the anchor pin.

28 Claims, 6 Drawing Sheets

SEAT BELT ARRANGEMENTS FOR CHILD SAFETY SEATS

TECHNICAL FIELD

The present invention relates to seat belt arrangements for automotive applications and, in particular, to child safety seats, where a buckle mechanism of the present invention is to be mounted. This buckle mechanism substantially comprises a guiding member, forming internal cavities for guiding and receiving tongues, latches for engaging with and locking the tongues and a button for disengaging the latches from the tongues.

BACKGROUND OF THE INVENTION

Seat belt arrangements for automotive applications are governed by laws and regulations regarding their design and construction. The seat belt arrangement must be safe to ensure proper protection of the passenger and the requirements to achieve this differ from country to country. Some countries require simultaneous latching of the tongues in the buckle to avoid that one tongue is improperly latched. In other countries it is required that the buckle is equipped with ejector means for ejecting the tongues out of the buckle when the release button is engaged. This makes it easier to determine if the tongues are properly latched in the buckle. Buckles in seat belt arrangements for small children (<9 kg) can be made from polymeric material whereas buckles for larger children often comprise metallic load-bearing parts. Various buckles have been designed, that aim to fulfill the national requirements, and some of them will be described below.

A buckle mechanism of the kind described above is for example shown in U.S. Pat. No. 5,267,377. The buckle mechanism according to this patent uses a single latch member for latching of the tongues, where the shoulder seat belts are attached. The single latch member pivots when only one tongue is inserted into the designated cavity. This means that when the second tongue is inserted, the first tongue becomes partially unlatched and might remain in a partial-latched position. This means that the tongue appears to be latched but the only force holding the tongue is the friction from being urged against the internal cavity by the latch spring. This can be very dangerous in a potential collision.

Furthermore, the aforementioned governing laws and regulations for buckles include limits for the required opening force of the buckle. There are both upper and lower limits between which exists only a narrow range of acceptable opening force values. Buckles of the constructions shown in U.S. Pat. No. 5,267,377, U.S. Pat. No. 4,617,705, and U.S. Pat. No. 5,813,097 are subject to further restriction of the range of opening forces due to the accumulation of manufacturing tolerances inherent in their making. This can be seen in the fact that the position and orientation of the latch member is controlled by the position of the bent features in the frame member or other supporting members in each of these devices. Each added positioning feature or member makes the exact position and orientation of the latch less precise. This results in greater difficulty during series production in which all buckles must be manufactured to meet the force range limitations with statistical certainty. These buckles are also sensitive to bending of the frame or other supporting members during dynamic loading as occurs during collisions. In these cases, it may be possible for the latch member to rotate to a less than ideal position.

Another buckle mechanism of the type described above is disclosed in U.S. Pat. No. 5,406,681. This buckle is constructed of polymeric material and used exclusively in seat belt arrangements for small children (<9 kg). While the construction of this buckle avoids the problems associated with the positioning of the latch member, i.e. accumulated tolerances and sensitivity to dynamic bending discussed above, its construction mandates that it only be used in applications for small children, due to the fact that the polymeric latch member is secured to the anchor pin which is then secured to the polymeric outer housing. The crash loads must then be transferred through the housing to the webbing, meaning that the magnitude of the loads it can carry is expressly limited through reliance on the polymeric housing to transfer load to the webbing.

The Present Invention

An extremely short load path may according to the present invention be attained by the features defined in claim 1, whereby the forces from a potential collision are transferred directly from the tongues to an anchor pin on which the latch(es) is secured. The load path is substantially direct and short and this design eliminates the reliance on frame features or other supporting members for the proper positioning of the latch member, resulting in both better management of opening forces and reduced likelihood of sensitivity to dynamic bending effects as well as allowing the frame to be constructed of metal or polymeric material regardless of the size of the child to be restrained.

The buckle mechanism can be arranged with one, two or more latches, which might be independently or simultaneously pivotable about the anchor pin. At least two latches combined with independently pivotable connection to the anchor pin enables independent latching. One embodiment is characterized by having the latches rigidly secured to the anchor pin, thereby forming one integral part. The anchor pin can also be divided before being welded to the latches. In this case, an external or internal pivot is provided to the anchor-pin parts to enable independent rotation of the latch-anchor-pin assembly.

The present invention comprises a guiding member, which can be formed from two separate parts, an upper and a lower plate, or can be made in one part of cast metal or polymeric material. This guiding member provides at least one cavity with guiding sidewalls. If the guiding member is formed with at least one internal sidewall, further cavities are provided. The cavities of the guiding member are provided for receiving and guiding the tongues of the tongue members.

The buckle mechanism is further equipped with a button for disengaging the at least one latch from the at least one tongue. This button can be pivotable about the anchor pin. Normally, the button is equipped with an external button return spring but the return spring can also be integrated with the button. If extra opening force is desired, the integrated button return spring can be combined with the external return spring.

When a tongue is entered into a cavity of the guiding member, the latch spring biases the latch to engage with the tongue. This latch spring can be positioned to only act against internal metal parts of the buckle mechanism. This makes it less sensitive to heat, since no polymeric parts are involved. If separate latching is desired, the latches are equipped with separate latch springs. These springs are preferably conical wire springs, which allow long travel with little obstruction.

The above-mentioned design of the buckle mechanism can be self-contained, which means that no housing is necessary for the buckle to remain operable. This is an important feature since the housing easily can be damaged in a potential collision.

The buckle can also optionally be outfitted with ejector springs with or without ejector spring spacers. These members act to eject the tongues out of the guiding member when the button is activated.

The buckle mechanism of the present invention is furthermore designed to be modular, i.e. easily be equipped with alternative features such as ejector springs, ejector spring spacers, button with integrated return spring and/or external return spring, independent or simultaneous latching, one or several tongues, etc.

DESCRIPTION OF A PREFERRED EMBODIMENT

Figure 1:
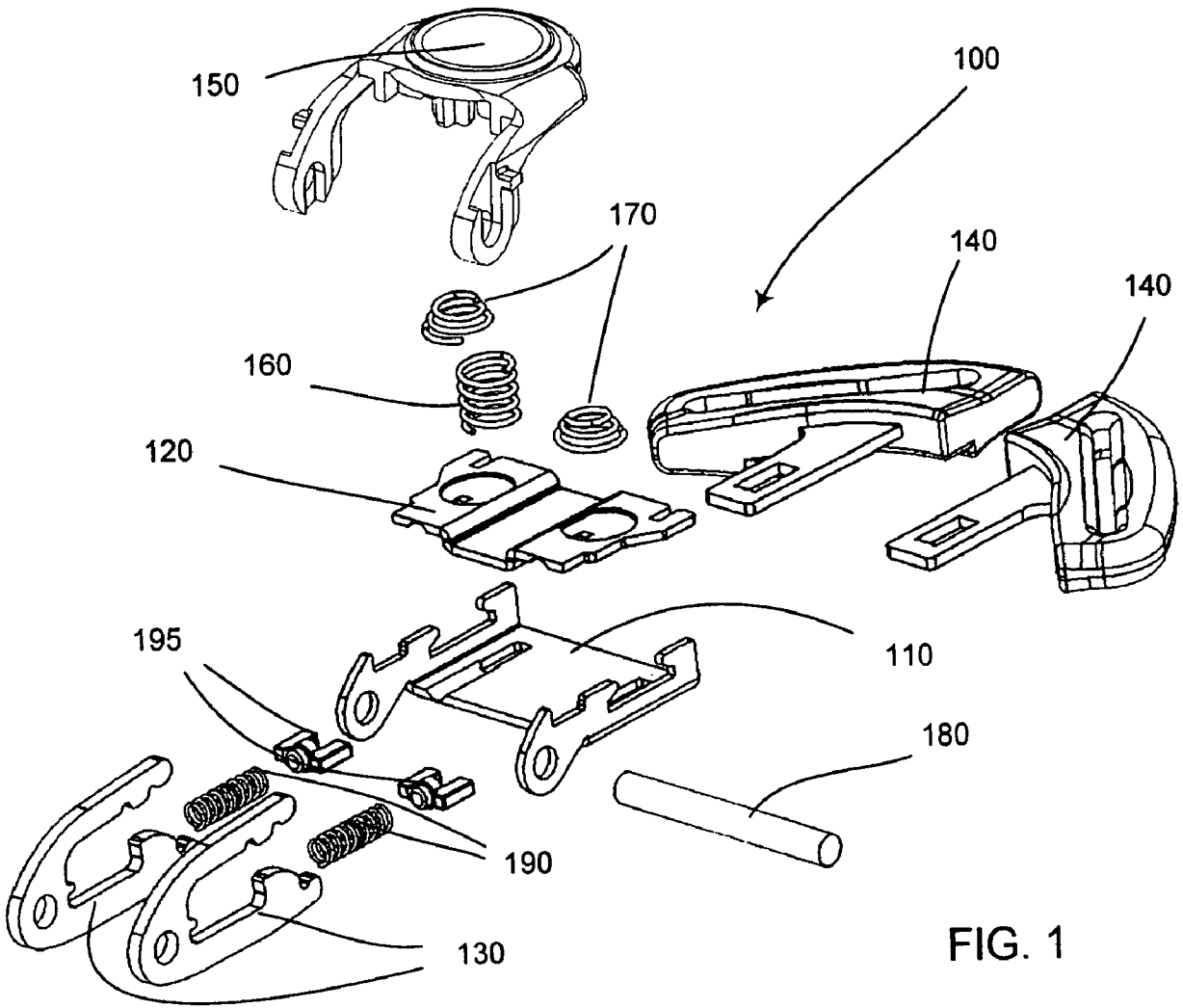
FIG. 1 is an exploded view of one embodiment of the buckle mechanism according to the invention.

Reference is first made to FIG. 1, showing the different parts of a buckle mechanism 100 according to the present invention in an exploded view. The buckle mechanism 100 according to the present invention comprises lower 110 and upper plates 120, two latches 130, two tongue members 140, a button 150, a button return spring 160, two latch springs 170, an anchor pin 180 and optionally two ejector springs 190 and two ejector spring spacers 195. The buckle mechanism 100 is to be placed within a housing 200 consisting of an upper 210 and a lower casing 220, see FIGS. 2 and 14.

Figure 3:
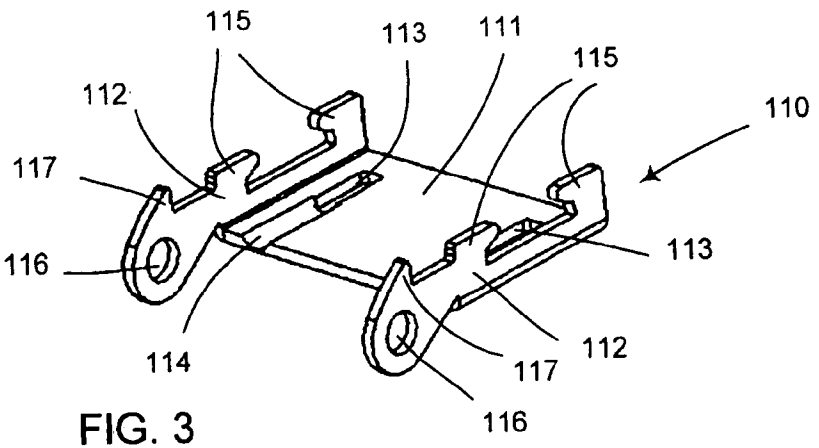
FIG. 3 is a perspective view of the lower plate according to the invention.

As is best shown in FIG. 3, the lower plate 110 is formed with a substantially flat central portion 111, having two sidewalls 112 projecting upwards at opposite sides of the flat portion 111. The flat portion 111 is further equipped with two openings 113 for receiving the two latches 130, and with two grooves 114, leading to the openings 113, for receiving the optional ejector springs 190 and ejector spring spacers 195, if desired and as explained below. The sidewalls 112 of the lower plate 110 have ears or lugs 115 on the upper edge for receiving and securing the upper plate 120. At their ends to the left in FIG. 3, the sidewalls 112 are further equipped with two outer anchor-pin holes 116 aligned for receiving the anchor pin 180. A heel 117 is formed to the left on each of the sidewalls 112 for a purpose to be explained.

Figure 4:
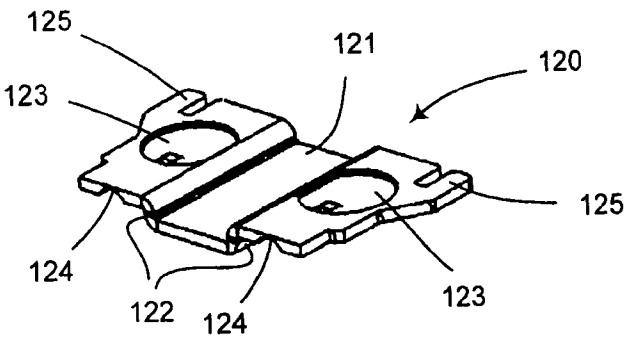
FIG. 4 is a perspective view of the upper plate according to the invention.
Figure 12:
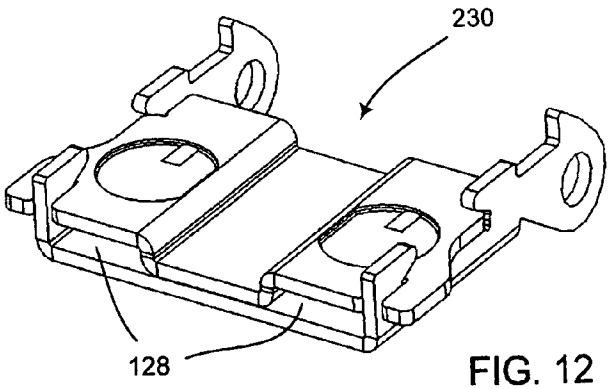
FIG. 12 is a perspective view of the guiding member in this case comprising the upper and lower plate.

The upper plate 120, best shown in FIG. 4, is also substantially flat with a recessed central portion forming a channel 121. The channel 121 provides vertical internal guiding walls 122 for guiding the tongues 141 within the cavities 128 formed by the upper 120 and lower plates 110 between the guiding walls 122 and the sidewalls 112, see FIG. 12. The upper plate 120 is further formed with two substantially circular recessions 123 on either side of the channel 121 for receiving the latch springs 170. The upper plate 120 is on the side facing downwards in FIG. 1 formed with grooves 124, analogous to the grooves 114 on the lower plate 110, for receiving the optional ejector springs 190 and ejector spring spacers 195, if desired. Both sides of the upper plate 120 is constructed with lugs 125 for engaging with corresponding ears 115 on the lower plate, resulting in secure attachment of the upper plate 120 on top of the lower plate 110.

Figure 5:
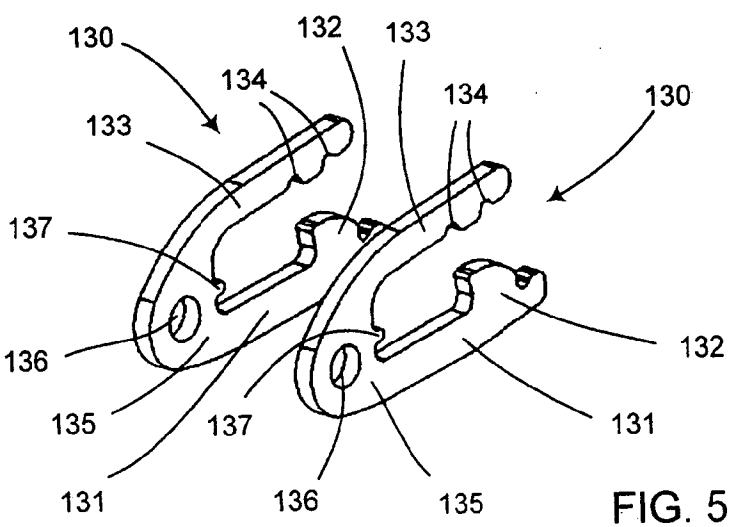
FIG. 5 is a perspective view of the latches according to the invention.
Figure 6:
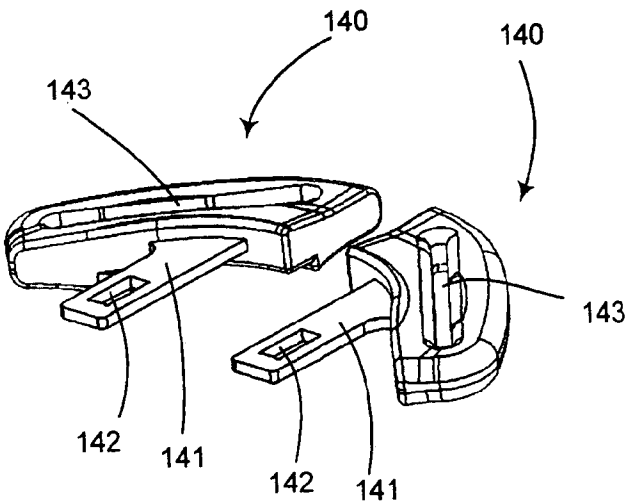
FIG. 6 is a perspective view of the tongue members according to the invention.
Figure 17:
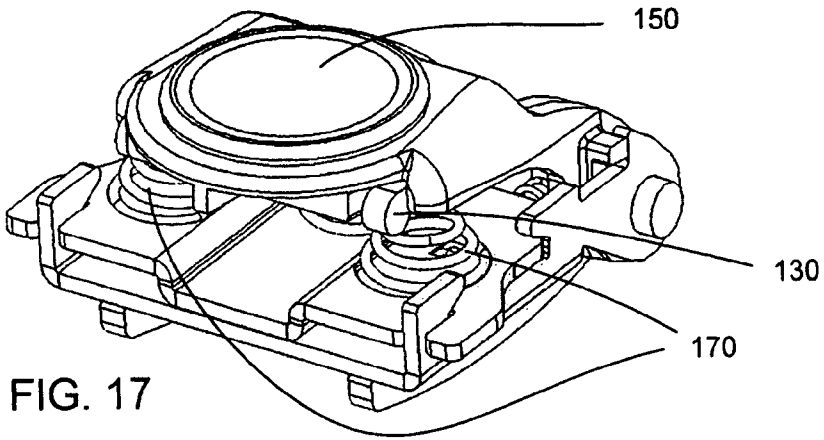
FIG. 17 is a perspective view showing how the latch springs act on the latches.

Referring to FIG. 5, the latches 130 are U-shaped parts, where a lower shank 131 of each latch 130 is equipped with a shoulder 132 for engaging with corresponding tongues 141 of the tongue members 140 (see FIG. 6). The other shank 133 of each latch 130 is formed with notches 134 for receiving the latch springs 170, as seen in FIG. 17. Each web 135 of the latches 130 is formed with an inner anchor-pin hole 136 for receiving the anchor pin 180. The edge facing forward to the right in FIG. 5, in the valley between the shanks 131, 133, is formed with a neck 137 for receiving the optional ejector springs 190.

Figure 13:
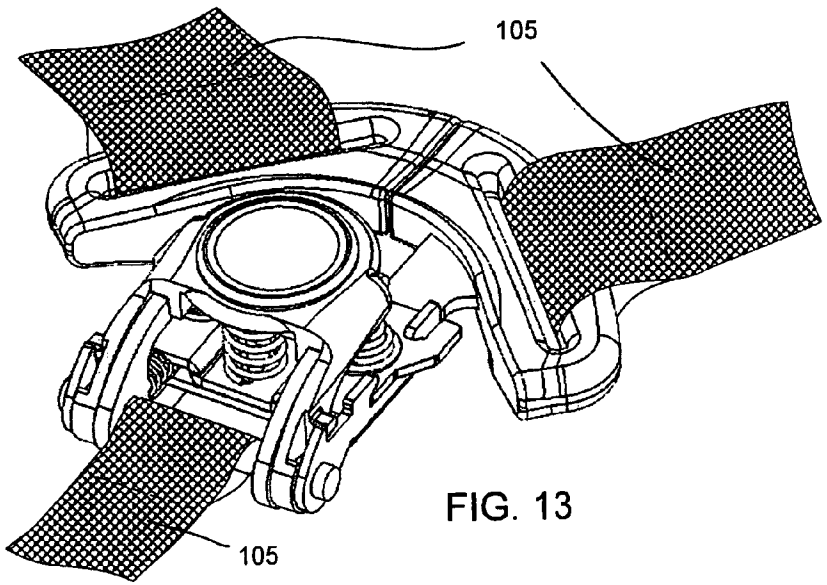
FIG. 13 is a perspective view of the buckle mechanism with an illustration of how the webbing is attached.

Referring to FIG. 6, the tongue members 140 comprise tongues 141 partly embedded in another material, preferably a polymeric material, for embracing webbing 105 of a seat belt, see FIG. 13. The tongues 141 are preferably manufactured from steel and are generally V-shaped. One shank of each tongue 141 is formed with an aperture 142 for engaging with the latches 130. The other shank of each tongue 141 is formed with an elongated slot 143, for receiving webbing 105 of a seat belt. The shank with the elongated slot 143 is generally covered with the embedding material.

Figure 8:
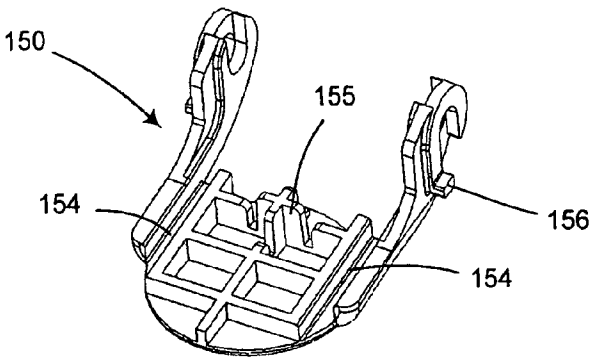
FIG. 8 is a perspective view from below of the button as seen in FIG. 7.
Figure 7:
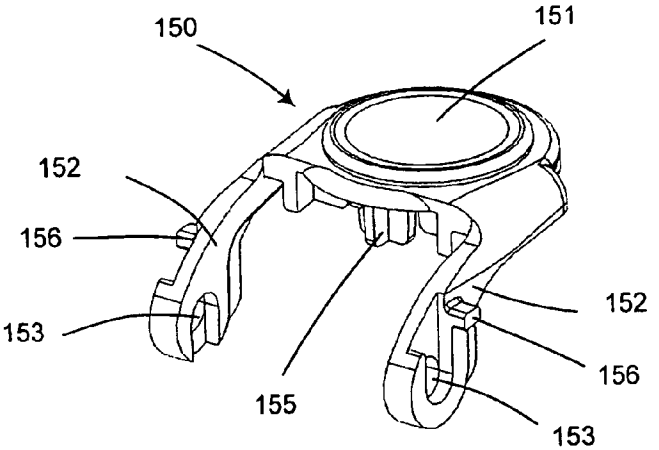
FIG. 7 is a perspective view of one embodiment of the button for opening the buckle.
Figure 11:
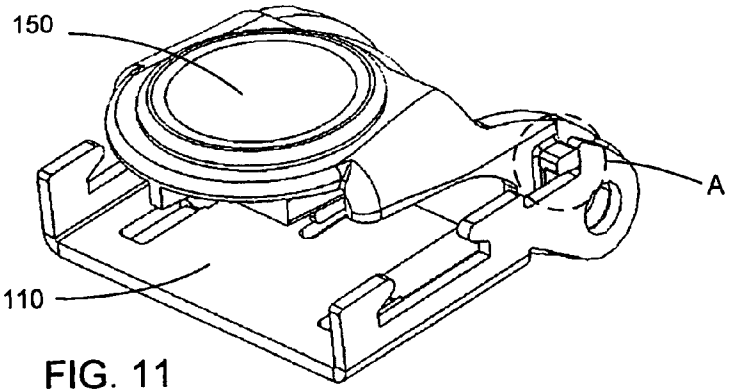
FIG. 11 is an assembly drawing of the button and the lower plate showing how the necks in the button engage the heels of the lower plate.

As shown in FIG. 7, the button 150 or the disengaging means for opening the buckle mechanism 100 is formed with a circular (might also be oval, rectangular or any other desired shape) flat portion 151 facing upwards. Legs 152 are integrally formed on opposite sides of the flat portion 151, which legs 152 extend to the side and downward (see also FIG. 1). The legs 152 are substantially flat, extending vertically, and are formed with two opposing central anchor-pin holes 153 for receiving the anchor pin 180. The flat portion 151 is on the side facing downwards equipped with generally flat sections 154, best seen in FIG. 8, for engaging the latches 130 during opening of the buckle mechanism 100. The button 150 is on the side facing downwards designed with a button return spring holder 155, shown from below in FIG. 8, for securing the button return spring 160 to the button 150. Moreover, the button 150 is formed with necks 156, which act as stops for the upward rotation of the button 150, when the necks make contact with the heels 117. This is best shown in FIG. 11 at A.

Now referring again to FIG. 1, the button return spring 160 is substantially cylindrical whereas the latch springs 170 are slightly conical, allowing for larger travel of the latches 130 without interference with the latch springs 170.

The anchor pin 180 is cylindrical and is manufactured with substantially the same outside diameter as the inside diameter of the anchor-pin holes 116, 136, 153 in the lower plate 110, the latches 130 and the button 150. The anchor pin also operates to hold the webbing 105 of the crotch belt, see FIG. 13.

The optional ejector springs 190 are substantially cylindrical. The ejector springs 190 operate to eject the tongue members 140 from the buckle mechanism 100 after the button 150 has been depressed.

Figure 10:
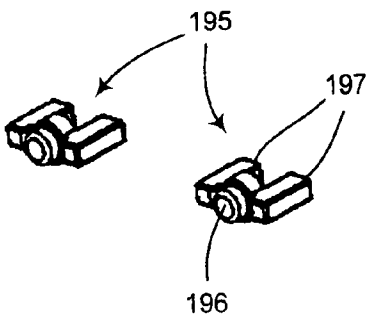
FIG. 10 is a perspective view of the ejector spring spacers.

The optional ejector spring spacers 195, see FIG. 10, are formed with a cylindrical portion 196, facing the ejector springs 190, and with two flat end portions 197 for engaging with an end surface of the tongues 141, facing to the left in FIG. 1 and FIG. 6. The ejector spring spacers 195 are preferably manufactured from a polymeric material. The tongues 141 of the tongue members 140 engage the ejector spring spacers 195, which in turn engage the latches 130.

These ejector springs 190 and ejector spring spacers 195 can be excluded since they do not affect the locking function of the buckle mechanism.

Figure 2:
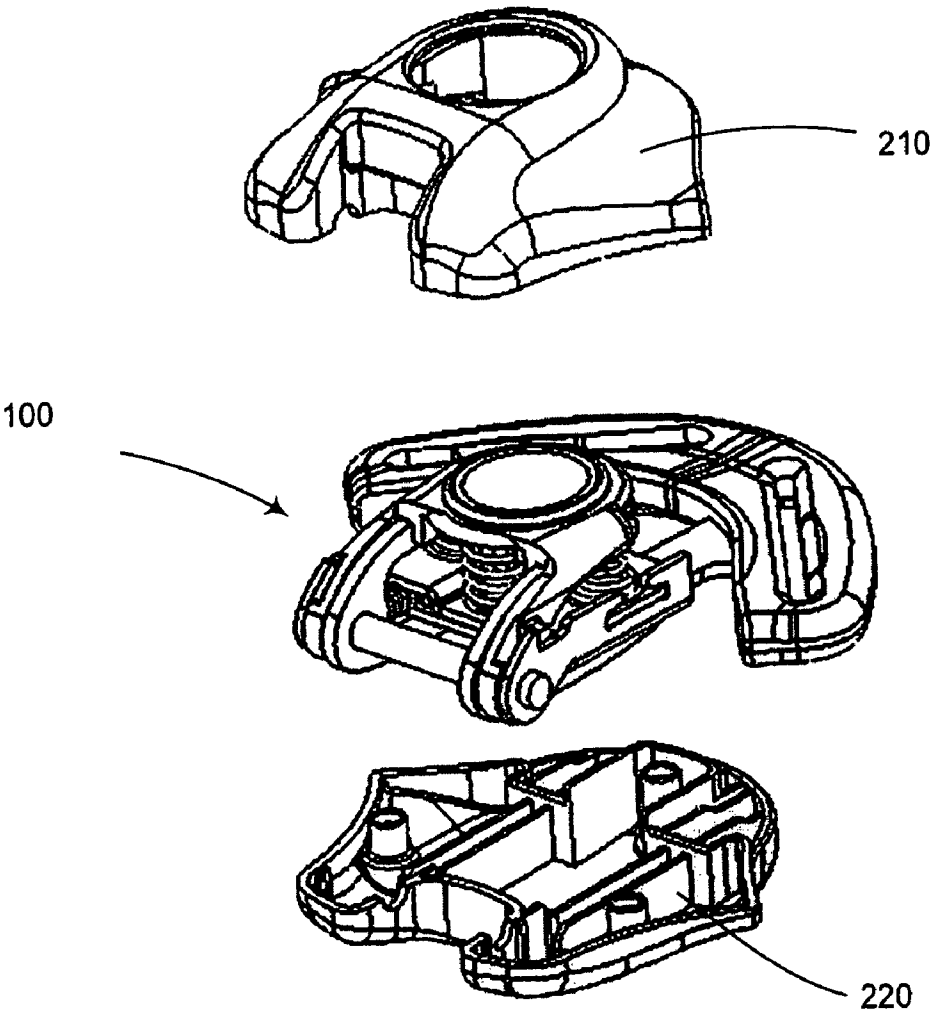
FIG. 2 is an exploded view in perspective of a buckle mechanism with its corresponding housing according to the invention.
Figure 14:
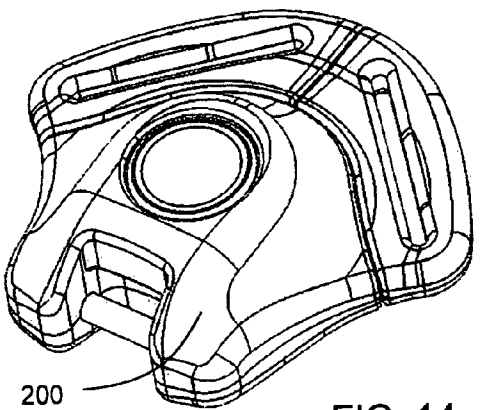
FIG. 14 is a perspective view of the buckle with the housing mounted around the buckle mechanism.

The housing 200 comprises an upper 210 and a lower plastic casing 220, as seen in FIGS. 2 and 14, which are mounted around the buckle mechanism 100 by screws, rivets, adhesive, ultra-sonic welding, plastic snap-connections or similar.

Alternative Embodiments

The above description of a preferred embodiment is not to be considered as limiting. The number of tongues 141, e.g., can vary between one, two or more.

Figure 16:
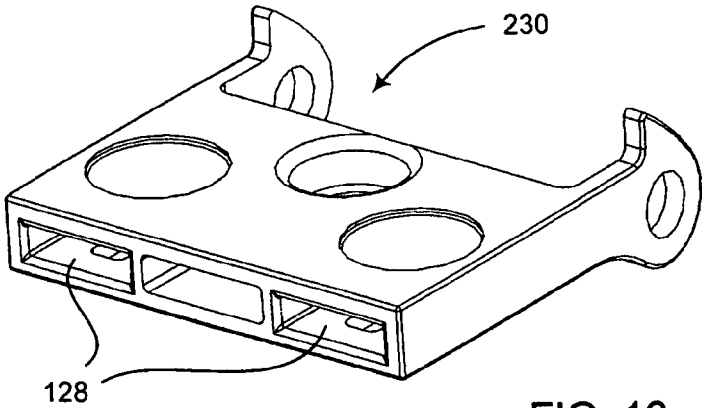
FIG. 16 is a perspective view of the guiding member seen in FIG. 15 as seen from another direction.
Figure 15:
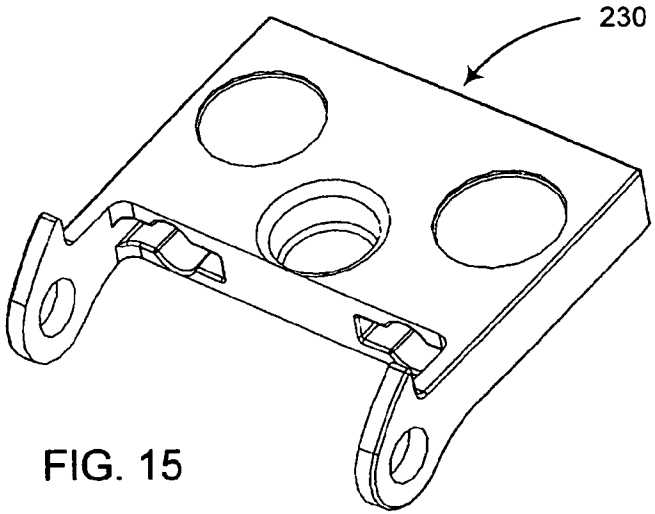
FIG. 15 is a perspective view of an alternative embodiment of the guiding member.

The upper plate 120 can be formed without the channel 121 for use with a single tongue. The tongue will then be wide enough to be guided by the sidewalls 112 and the lower 110 and upper plate 110. The internal guiding walls 122 can alternatively be formed in the lower plate 110 or be inserted and secured as separate parts. The guiding member can also be manufactured as a single part, see FIGS. 15 and 16, through die-casting, extrusion, molding or similar.

The latches 130 can alternatively be rigidly secured to the anchor pin 180. This makes independent latching impossible, unless the anchor pin 180 is divided in two parts, before or after being welded to the latches 130, and the two parts are pivoted around an outer or inner pivot.

Figure 9:
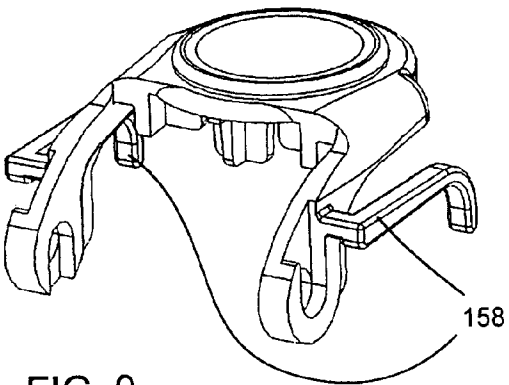
FIG. 9 is a perspective view of an alternative embodiment of the button.

The button 150 can alternatively be designed as shown in FIG. 9, where the return spring function of the button return spring 160 is integrally formed in the button 150. The button 150 is in this embodiment formed with springing legs 158 that either rest on the lugs 125 of the upper plate 120 or on the lower casing 220, when assembled. This eliminates the need for a separate button return spring 160. The button 150 with the integrated return spring 158 can also be equipped with the separate button return spring 160 for increasing the required opening force. For this reason, the button 150 with the integrated button return spring 158 can also be formed with the button return spring holder 155.

Other types of spring means are also possible, such as blade springs, polymeric springs, fluid springs or similar.

The ejector spring spacers 195 can also be designed for retaining the latches 130 in the open position, after the buckle has been opened. For this purpose a harder material such as die-casting alloys or steel might be suitable.

The preferred material for the load bearing parts is hardened steel but other materials are also possible, such as steel alloys, titanium, die-casting alloys (zinc, aluminum), polymeric materials etc. that do not inherently change the function of the designed part or mechanism. The button 150 and the housing 200 are preferably manufactured in a polymeric material, but can alternatively be manufactured in steel, die-casting alloys etc.

Assembly

The upper plate 120 is mounted on top of the lower plate 110 and is secured by the lugs 115, 125 of the upper 120 and lower plate 110. This assembly of the lower 110 and upper plate 120 is called the guiding member 230. The latches 130 are placed on either side of the channel 121 of the upper plate 120, aligned with the openings 113 in the lower plate 110 for receiving the shoulders 132 of the latches 130, and with the shanks of the latches on either side of the guiding member 230. The optional ejector springs 190 and ejector spring spacers 195 or only the optional ejector springs 190 are inserted between the upper 120 and lower plate 110 and are kept in place by the latches 130. The button return spring 160 is placed on top of the upper plate 120 and the latch springs 170 are placed in their corresponding recessions 123. The latches 130 are placed in position for engaging with the latch springs 170. The button 150 is placed on top of the latches 130 and the button return spring 160, above the upper plate 120. The anchor-pin holes 116, 136, 153 of the button 150, the lower plate 110 and the latches 130 are aligned for receiving the anchor pin 180. The anchor pin 180 is inserted and is locked in place by some locking means, e g the housing 200, a locking ring (not shown), or by riveting. Finally, the buckle mechanism 100 is placed in the lower casing 210 and the upper casing 220 is placed on top of the mechanism 100. The two casings are joined by some fastening means.

The preferred embodiment is modular and is built for receiving optional features such as ejector springs 190, ejector spring spacers 195 and an additional button return spring (integrated 158 and external 160), but their inclusion is up to the individual customer, or regulatory requirements.

Operation

The buckle mechanism 100 is now ready for receiving the tongues 141 of the tongue members 140. The tongues 141 are inserted in the cavities 128 provided between the upper 120 and lower plate 110 and between the guiding walls 122 and the sidewalls 112. The tongues 141 engage the shoulders 132 on the latches 130 and force them to rotate about 5–10°. The tongues 141 can then be depressed further and at the end of the depression the shoulders 132 on the latches 130 engage with the apertures 142 in the tongues 141, as the latch springs 170 push the shoulders 132 of the latches 130 back to their locking position.

The latches 130 can rotate independently and the tongues 141 can thus be entered independently. This is in the art referred to as independent latching.

The tongues 141 might engage the optional ejector springs 190 or the optional ejector springs 190 and ejector spring spacers 195. The ejector springs 190 function to automatically eject the tongues 141 when the latches 130 are removed from the apertures 142 in the tongues 141 by depressing the button 150.

Depressing the button 150 opens the buckle mechanism 100 by forcing the latches 130, via the flat sections 154, to rotate and eventually disengage from the tongues 141.

The invention claimed is:

1. A buckle mechanism for a seat belt arrangement of a child safety seat comprising a guiding member forming at least one internal cavity for guiding and receiving at least one tongue of a tongue member, at least one latch for engaging with and locking the at least one tongue and disengaging means for disengaging the at least one latch from the at least one tongue, wherein the at least one latch is pivotable and connected with an anchor pin, to which webbing of a seat belt is attached, the other webbing being attached to the at least one tongue member, and the at least one latch engages with the at least one tongue, the force transmission from the webbings through the mechanism only consisting of the at least one tongue, the at least one latch and the anchor pin.

2. A buckle mechanism according to claim 1, wherein the at least one latch is pivotally connected with the anchor pin.

3. A buckle mechanism according to claim 1, wherein the buckle mechanism has at least two latches.

4. A buckle mechanism according to claim 3, wherein the at least two latches are independently pivotable about the anchor pin.

5. A buckle mechanism according to claim 3, wherein the at least two latches are rigidly secured to the anchor pin.

6. A buckle mechanism according to claim 3, wherein the anchor pin is divided into at least two parts, where each anchor-pin part is rigidly secured to each of the at least two latches, and the thus formed at least two parts are pivotable about an outer or inner pivot.

7. A buckle mechanism according to claim 1, wherein the guiding member comprises a lower and an upper plate.

8. A buckle mechanism according to claim 7, wherein the guiding member has sidewalls for providing, together with the lower and upper plate, at least one internal cavity for guiding at least one tongue of at least one tongue member.

9. A buckle mechanism according to claim 8, wherein the guiding member has internal guiding sidewalls, for providing at least two internal cavities together with the sidewalls for guiding at least two tongues of at least one tongue member.

10. A buckle mechanism according to claim 1, wherein the guiding member is constructed in one piece from die-cast metal or polymeric material.

11. A buckle mechanism according to claim 10, wherein the guiding member has at least one internal cavity for guiding at least one tongue of at least one tongue member.

12. A buckle mechanism according to claim 11, wherein the guiding member has internal guiding sidewalls for providing at least two internal cavities for guiding at least two tongues of at least one tongue member.

13. A buckle mechanism according to claim 1, wherein disengaging means comprising a button for disengaging the at least one latch from the at least one tongue.

14. A buckle mechanism according to claim 13, wherein the button is pivotally connected with the anchor pin.

15. A buckle mechanism according to claim 13, wherein the button is equipped with an external return spring.

16. A buckle mechanism according to claim 15, wherein the button has both an integrated return spring and an external button return spring.

17. A buckle mechanism according to claim 13, wherein the button has an integrated return spring.

18. A buckle mechanism according to claim 17, wherein the integral return spring of the button is formed by at least one springing leg which abuts the guiding member or on a housing for containing the buckle mechanism.

19. A buckle mechanism according to claim 1, wherein the buckle mechanism has at least one latch spring means for biasing the at least one latch to a locking position when the at least one tongue is pushed into its locked position.

20. A buckle mechanism according to claim 19, wherein the buckle mechanism has at least one independent spring means for biasing each of the at least two latches to a locking position when the at least one tongue is pushed into its locked position.

21. A buckle mechanism according to claim 19, wherein the buckle mechanism has a latch spring means acting only on internal metal parts of the buckle mechanism.

22. A buckle mechanism according to claim 19, wherein the latch spring means are wire springs.

23. A buckle mechanism according to claim 22, wherein the latch spring means are conical wire springs.

24. A buckle mechanism according to claim 1, whereby being self-contained with only the anchor pin, the at least one latch, the latch spring means, the guiding member and the disengaging means.

25. A buckle mechanism according to claim 1, further comprising ejector springs for biasing the at least one tongue out of the at least one internal cavity when the at least one latch is disengaged from the at least one tongue.

26. A buckle mechanism according to claim 25, further comprising at least one ejector spring spacer, being interposed between the at least one ejector spring and the at least one tongue during locking operation.

27. A buckle mechanism according to claim 26, wherein the at least one ejector spring spacer is guided by grooves in the guiding member.

28. A buckle mechanism according to claim 1, further comprising a housing comprising an upper and lower casing and containing the buckle mechanism, the housing and the buckle mechanism together forming a buckle.

* * * * *